US005946643A

United States Patent [19]

Zakutin

[11] Patent Number: 5,946,643

[45] Date of Patent: Aug. 31, 1999

[54] SPEED-SENSING PROJECTILE

[76] Inventor: David Zakutin, 170 University Ave. West, Suite 12-103, Waterloo, Ontario, Canada, N2L 3E9

[21] Appl. No.: 09/061,856

[22] Filed: Apr. 17, 1998

Related U.S. Application Data

[63] Continuation of application No. 08/742,920, Nov. 1, 1996, Pat. No. 5,761,096.

[51] Int. Cl.[6] ..... G06F 15/20

[52] U.S. Cl. ..... 702/149; 702/142

[58] Field of Search ..... 702/141, 142–149, 702/176, 178, 187; 340/309.15; 368/2, 3, 225; 200/237

[56] References Cited

U.S. PATENT DOCUMENTS

| | | |
|---|---|---|
| 4,201,898 | 5/1980 | Jones et al. . |
| 4,771,394 | 9/1988 | Cavanaugh . |
| 4,775,948 | 10/1988 | Dial et al. . |
| 5,163,014 | 11/1992 | Colimeri . |
| 5,199,705 | 4/1993 | Jenkins et al. . |
| 5,393,974 | 2/1995 | Jee . |
| 5,526,326 | 6/1996 | Fekete et al. . |
| 5,566,934 | 10/1996 | Black et al. . |
| 5,636,146 | 6/1997 | Flentor et al. . |
| 5,761,096 | 6/1998 | Zakutin ..... 702/149 |

FOREIGN PATENT DOCUMENTS

| | | |
|---|---|---|
| 2190846 | 12/1987 | United Kingdom . |
| 2208439 | 3/1989 | United Kingdom . |
| 296195 | 6/1996 | United Kingdom . |

*Primary Examiner*—John Barlow
*Assistant Examiner*—Craig Steven Miller
*Attorney, Agent, or Firm*—Connolly & Hutz

[57] ABSTRACT

A speed-sensing projectile such as for example a baseball includes a generally spherical body. An inertial switch is positioned within the body and is actuable between open and closed conditions in response to accelerations of the body greater than a threshold value. A processor also within the body is responsive to the inertial switch and calculates the average speed at which the baseball is thrown over a fixed distance. A visible display on the body is in communication with the processor and displays the calculated speed.

43 Claims, 16 Drawing Sheets

SPEED-SENSING PROJECTILE

This application is a continuation of application Ser. No. 08/742,920, filed Nov. 1, 1996, now U.S. Pat. No. 5,761,096.

FIELD OF THE INVENTION

The present invention relates to speed-sensing devices and in particular to a speed-sensing projectile such as a baseball, hockey puck or the like.

BACKGROUND OF THE INVENTION

In many sports, it is desired to determine how fast a projectile is thrown or shot. For example, in baseball the speed at which a pitcher throws a baseball has conventionally been measured using a radar gun positioned behind the catcher to whom the pitcher throws the ball. In professional baseball this method is satisfactory but the costs associated with purchasing radar guns makes this method impractical for amateur sports.

A baseball having inherent speed-measuring capabilities has been considered and is disclosed in U.S. Pat. No. 4,775,948 to Dial et al. The speed-measuring baseball includes a speed determining module accommodated in a hollowed-out portion of the baseball. The speed determining module includes a start button which is depressed by the pitcher when the pitcher is ready to throw the ball. When the ball is thrown and the start button is released, a programmable counter counts down a plurality of times for time intervals of the flight of the thrown baseball. A piezo-electric stop switch stops the counter upon impact of the baseball with the catcher's glove. The counter data is then latched and used to drive an LCD display panel to provide a visual indication of the speed at which the baseball was thrown.

Although this reference discloses a speed-measuring baseball, problems exist in that the pitcher must ensure that the start button is maintained in the depressed condition until the baseball is released. This requires the pitcher to hold the baseball in a specific manner each time the baseball is thrown. If the start button is not depressed or if the start button is released prior to the baseball being thrown, no or an inaccurate speed measurement will result. In addition, the use of a moveable start button adjacent the outer surface of the baseball is prone to mechanical failure as a result of on-going impacts during use of the speed-measuring baseball.

It is therefore an object of the present invention to provide a novel speed-sensing projectile such as for example a baseball which obviates or mitigates at least one of the above-identified disadvantages.

SUMMARY OF THE INVENTION

According to one aspect of the present invention there is provided a speed-sensing projectile comprising:

a body;

an inertial switch within said body and actuable between open and closed conditions in response to accelerations of said body;

a processor within said body, said processor being responsive to actuations of said inertial switch to detect launching of said projectile and the subsequent stopping thereof and calculating the average speed of said projectile over the travel thereof; and a visible display on said body in communication with said processor to display said calculated average speed.

In accordance with another aspect of the present invention there is provided a speed-sensing baseball comprising:

a generally spherical body;

an inertial switch actuable between open and closed conditions in response to accelerations of said body;

a processor responsive to said inertial switch to calculate the average speed at which said baseball is thrown over a fixed distance, said inertial switch and said processor being positioned within said body; and a visible display on said body in communication with said processor to display said calculated average speed.

In a preferred embodiment, the processor calculates the average speed of the thrown baseball by examining the elapsed time between throwing of the baseball and the subsequent catching thereof. It is also preferred that the fixed distance is selected to be equal to the distance between a pitcher's mound and home plate.

Preferably, the inertial switch includes an outer casing having a conductive inner surface defining one terminal thereof and an electrically conductive spring member within the outer casing and defining the other terminal of the inertial switch. The spring member is electrically isolated from the outer casing but is movable in response to accelerations of the baseball to contact the conductive inner surface and close the inertial switch. In a preferred embodiment, the spring member is in the form of a helical coil spring secured at one end to a conductive pin passing through an insulated cap on one end of the outer casing.

Preferably, the speed-sensing baseball further includes a power supply accommodated in a first hollowed-out portion of the body. The processor and display are preferably accommodated in a second hollowed-out portion of the body diametrically opposite the first hollowed-out portion. Preferably, the power supply and processor and display are weighted to counterbalance the speed-sensing baseball.

In a preferred embodiment, the display is resettable in response to the detection of a predetermined sequence of events by the processor. Preferably, the predetermined sequence of events is at least three impacts of the baseball that occur within a specified period of time which are sufficient to cause the inertial switch to move to a closed condition.

According to still yet another aspect of the present invention there is provided a speed-sensing projectile comprising:

a body; and a processing and display module within said body to monitor the elapsed time said body takes to travel a fixed distance and to calculate and display the average speed at which said projectile travels over said fixed distance, said processing and display module being reset in response to the detection of a predetermined sequence of events in the form of at least three impacts of said projectile occurring within a specified period of time.

In still yet another aspect of the present invention there is provided a speed-sensing projectile comprising:

a body;

a processing and display module within said body to monitor the elapsed time said body takes to travel a fixed distance and to calculate and display the average speed at which said projectile travels over said fixed distance; and a power supply module to supply power to said processing and display module, said processing and display module and power supply module being accommodated in diametrically opposed hollowed-out portions in said body and weighted to counterbalance said body.

The present invention provides advantages in that the speed of the projectile can be measured accurately without requiring an individual to position or hold the projectile in a specific manner before launching the projectile. Also, the design of the speed-sensing projectile is such that there are no moving parts near the outer surface of the projectile which may be prone to mechanical failure as a result of on-going impacts that occur during use of the projectile.

BRIEF DESCRIPTION OF THE DRAWINGS

Embodiments of the present invention will now be described more fully with reference to the accompanying drawings in which.

DETAILED DESCRIPTION OF THE PREFERRED EMBODIMENT

Figure 1A:
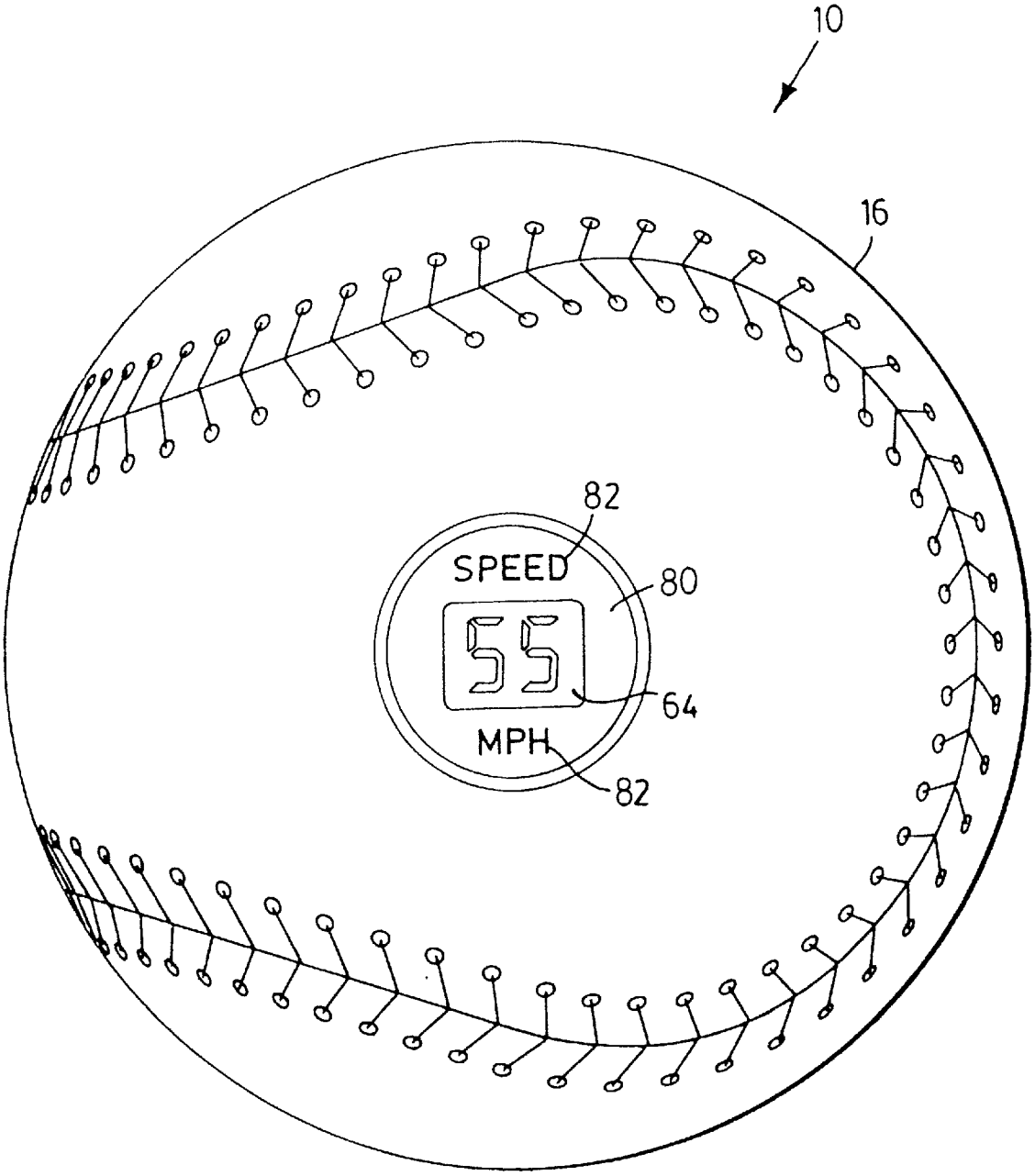
FIGS. 1*a* and 1*b* are plan views of a speed-sensing projectile in the form of a baseball in accordance with the present invention.
Figure 1B:
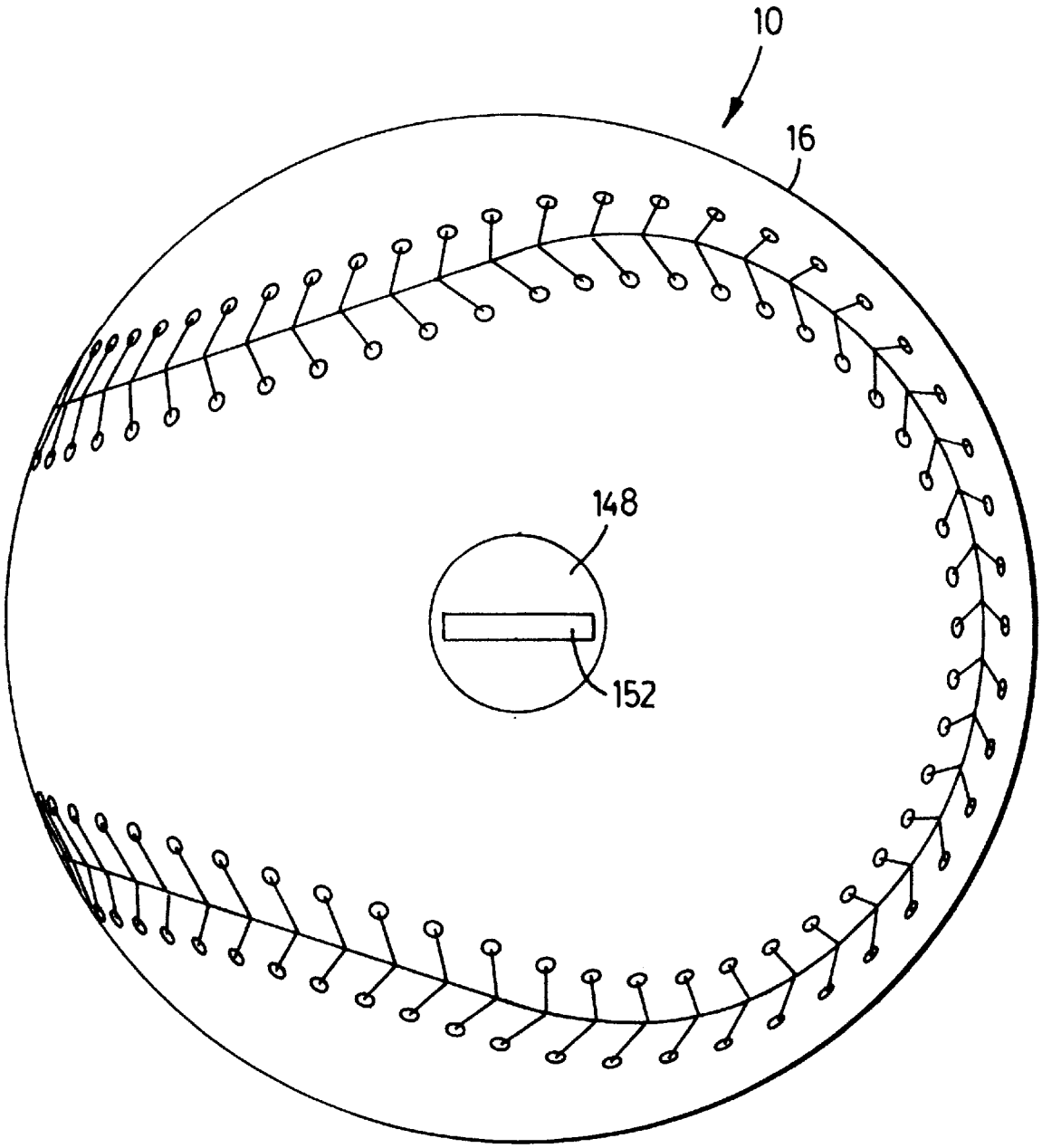
Figure 2:
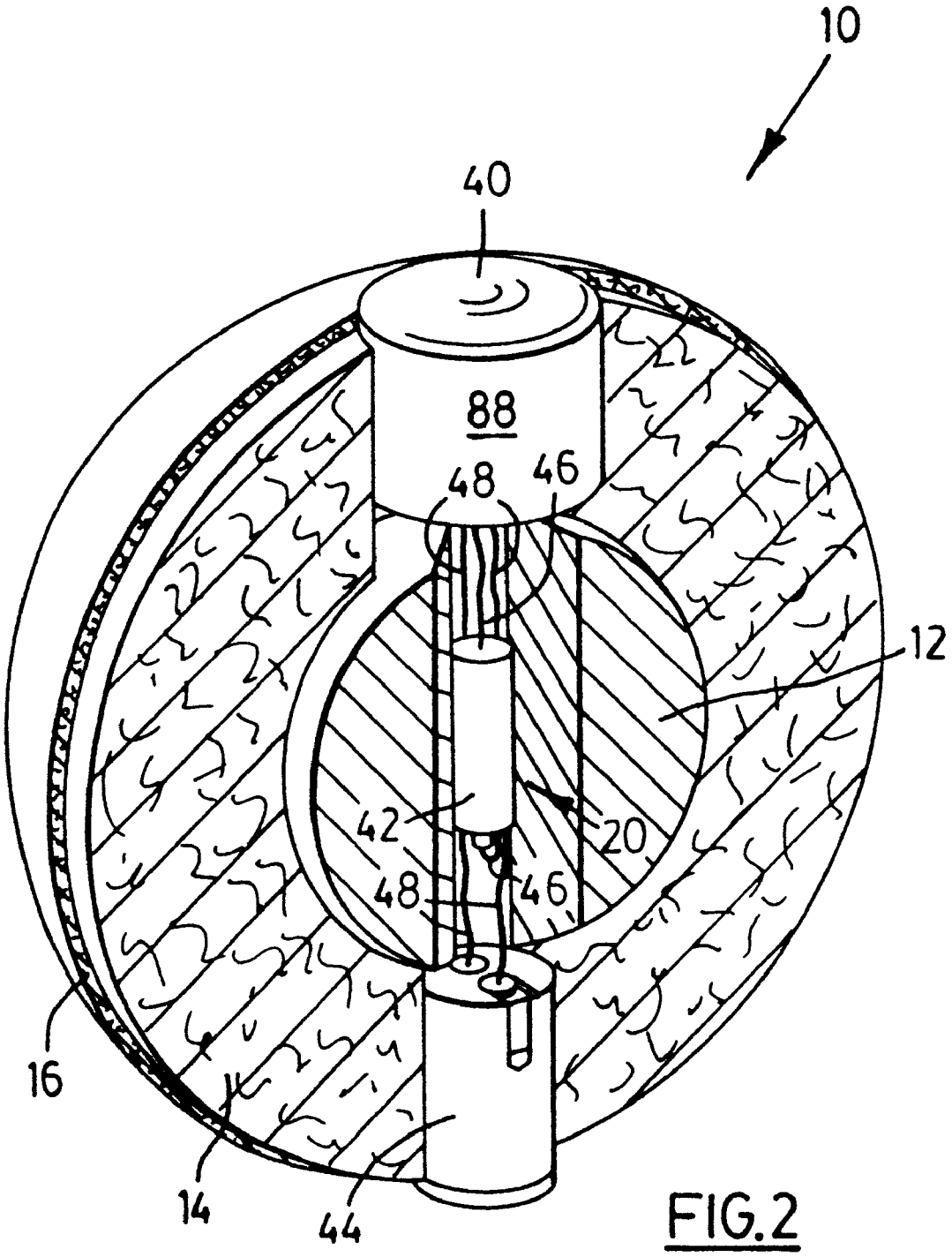
FIG. 2 is a cross-sectional view of the speed-sensing baseball of FIG. 1.
Figure 3:
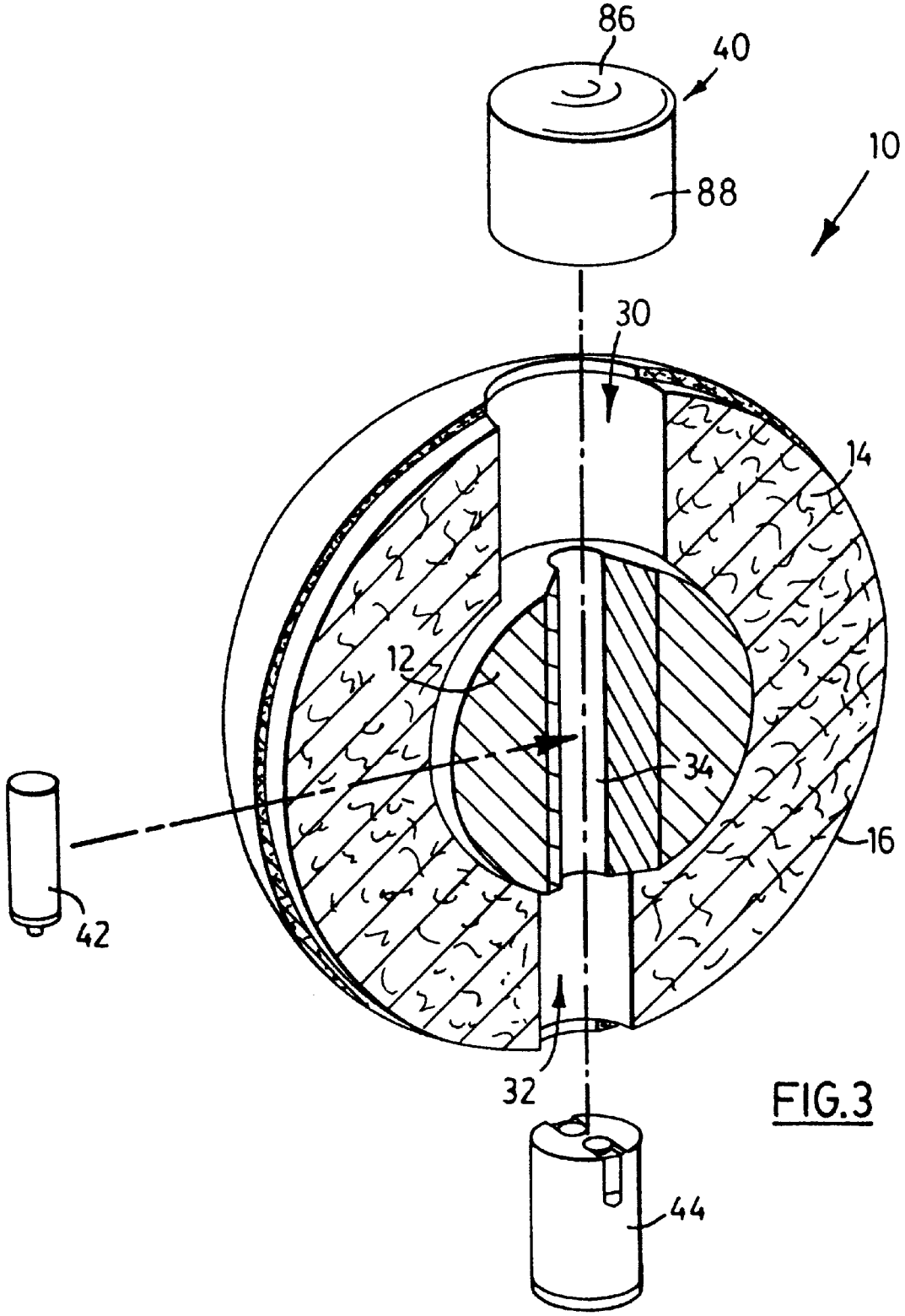
FIG. 3 is an exploded perspective view of FIG. 2.

Referring now to FIGS. 1*a* to 3, a speed-sensing projectile in the form of a baseball is shown and is generally indicated to by reference numeral 10. Baseball 10, in this embodiment, includes a solid spherical core 12 surrounded by a thick layer of wound yarn 14. A leather outer skin 16 surrounds the layer of wound yarn 14 and is stitched along seams. Baseball 10 is partially hollowed-out to accommodate a speed-measuring and display unit generally indicated to by reference numeral 20. Speed-measuring and display unit 20 is operable to calculate and display the speed of the baseball 10 after it has been thrown a fixed distance and caught without requiring the thrower to hold the baseball in any specific manner prior to throwing the baseball. The speed-measuring and display unit 20 can be reset easily allowing the speed of the baseball to be displayed each time the baseball is thrown. Further details of the speed-sensing baseball 10 and its operation will now be described.

Baseball 10 has two diametrically opposed radial bores 30 and 32 formed therein via a die cut operation which extend through both the outer skin 16 and the layer of wound yarn 14 and terminate at the core 12. A smaller diameter bore 34 extends through the core 12 to connect bores 30 and 32. The speed-measuring and display unit 20 includes a processing and display module 40 to calculate and display the speed at which the baseball is thrown over a fixed distance, an accelerometer also referred to as an inertial switch 42 responsive to accelerations of the baseball 10 and a power supply module 44 to supply power to the processing and display module 40. The processing and display module 40 is accommodated by bore 30 and is positioned so that it is spaced from the core 12 with its outer surface flush with the outer skin 16.

The power supply module 44 is accommodated by bore 32 and extends from the core 12 to the outer skin 16. The outer surface of the power supply module 44 is also flush with the outer skin 16. The inertial switch 42 is centrally positioned within bore 34. A pair of electrical leads 46 extend from the processing and display module 40 to the inertial switch 42 and a pair of electrical leads 48 extend from the power supply module 44 to the processing and display module 40. The processing and display module 40 and the power supply module 44 are designed so that they counterbalance one another and do not offset the center of mass of the baseball 10 to any appreciable extent.

Figure 4:
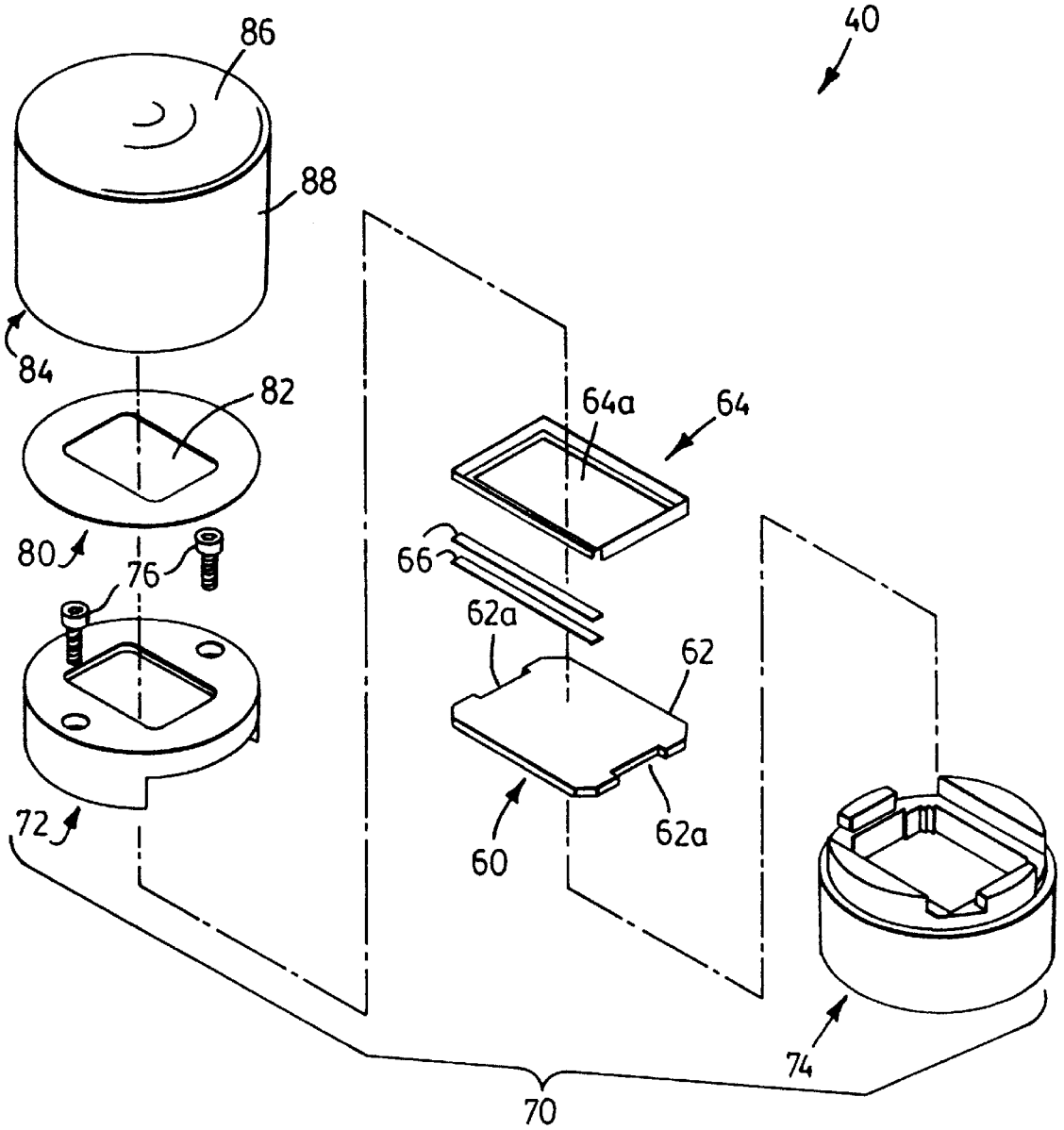
FIG. 4 is an exploded perspective view of a speed-measuring and display unit forming part of the speed-sensing baseball of FIG. 1.

Referring now to FIG. 4, the processing and display module 40 is better illustrated. As can be seen, the processing and display module 40 includes a microprocessor-based processing unit 60 mounted on one side of a printed circuit board 62. A multi-digit LCD panel 64 overlies the other side of the printed circuit board 62 and is electrically connected to the printed circuit board 62. An elastomeric connector 66 acts between the LCD panel 64 and the printed circuit board 62. Conductive tracing (not shown) on the printed circuit board 62 electrically connects the LCD panel 64 and the processing unit 60. The LCD panel 64 and printed circuit board 62 are accommodated within a plastic, generally cylindrical casing 70 defined by a pair of separable parts 72 and 74 respectively that are secured together by fasteners 76 in the form of screws.

Figure 5A:
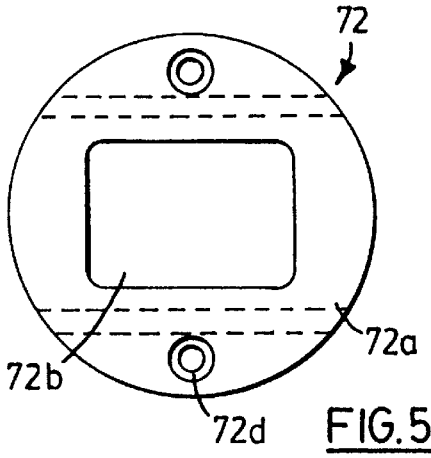
FIGS. 5*a* to 5*c* are top plan, front elevational and side elevational views respectively of a top casing part forming part of the speed determining module of FIG. 4.
Figure 5B:
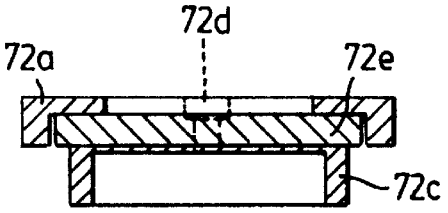
Figure 5C:
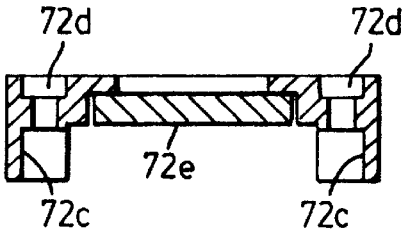

FIGS. 5*a* to 5*c* best illustrate part 72 and as can be seen, part 72 includes a circular top 72*a* having a generally rectangular aperture 72*b* therein sized to expose the display surface 64*a* of the LCD panel 64. A pair of diametrically opposed side walls 72*c* depend from the peripheral edge of the top 72*a* and extend partially about the circumference of the top. A pair of counterbores 72*d* extend through the top 72*a* at diametrically spaced locations adjacent the midpoint of the side walls 72*c*. An internal rectangular ring 72*e* depends from the undersurface of the top 72*a* and surrounds the LCD panel 64.

Figure 6A:
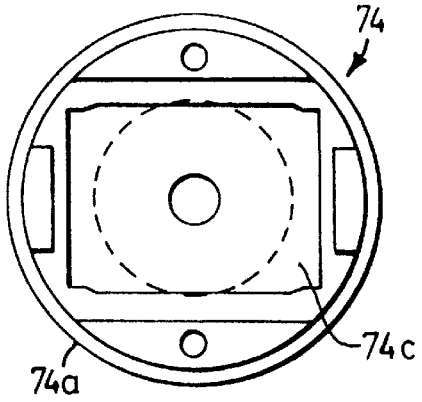
FIGS. 6*a* to 6*c* are top plan, front elevational and side elevational views of a bottom casing part forming part of the speed determining module of FIG. 4.
Figure 6B:
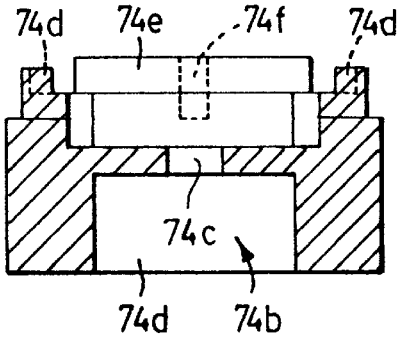
Figure 6C:
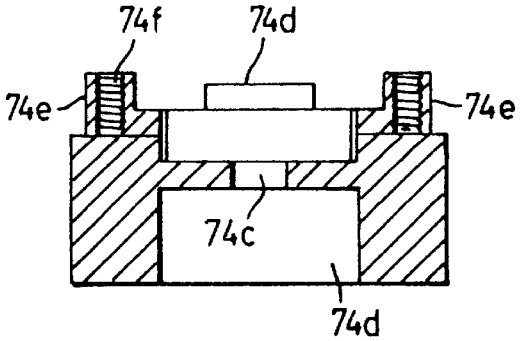
Figure 7A:
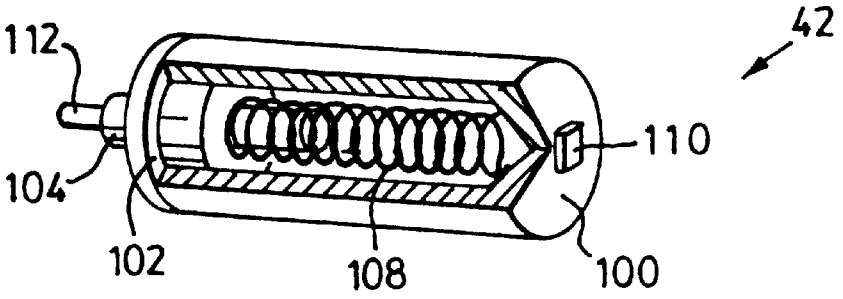
FIG. 7*a* is a perspective view, partially in section, of an inertial switch forming part of the speed-sensing baseball of FIG. 1.
Figure 7B:
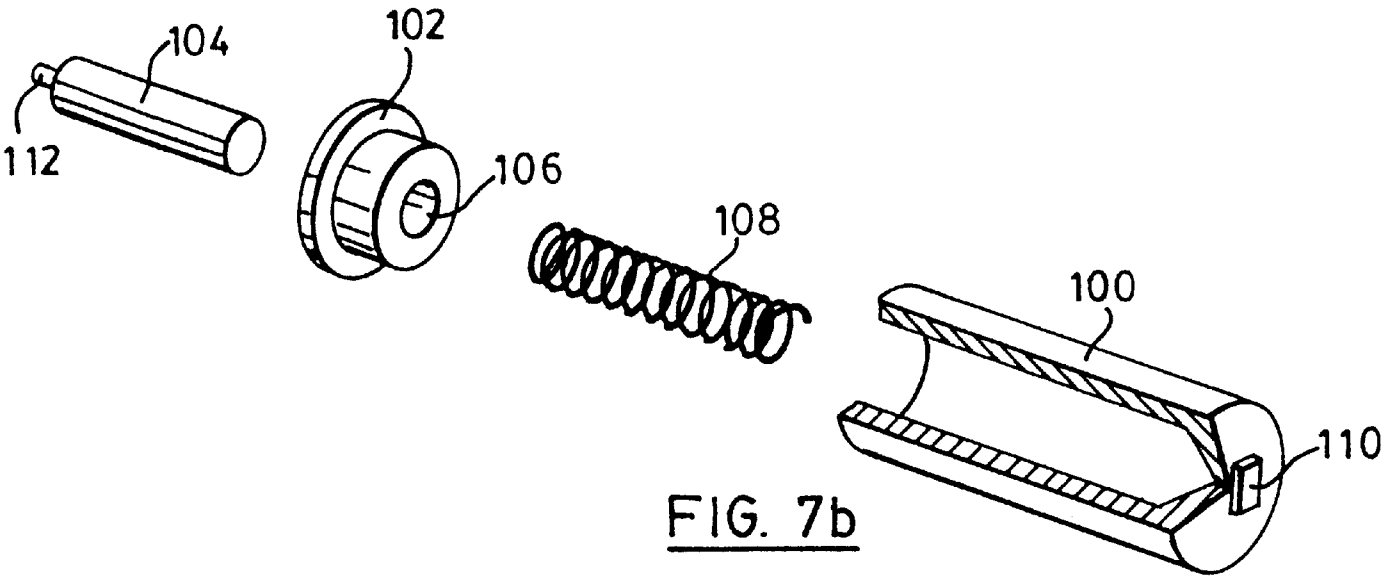
FIG. 7*b* is an exploded perspective view of FIG. 7*a;*

Part 74 is best illustrated in FIGS. 6*a* to 6*c*. Part 74 includes a generally cylindrical, tubular body 74*a* having a stepped, central passage 74*b* therein which opens up into a rectangular recess 74*c* at the upper end of the body 74*a* sized to accommodate the processing unit 60 on the printed circuit board 62. The stepped passage 74*b* includes an inner smaller diameter section 74*c* and an outer larger diameter section

74*d*. The dimensions of the passage 74*b* are selected to maintain the weight of the processing and display module 40 so that it counterbalances the power supply module 44. The electrical leads 48 from the power supply module 44 run through the central passage 74*b* and are connected to the printed circuit board 62. A pair of diametrically opposed lugs 74*d* extend upwardly from the top of the body 74*a* and are received by notches 62*a* in opposed ends of the printed circuit board 62 to inhibit any lateral movement of the printed circuit board 62. Diametrically opposed arcuate projections 74*e* are also provided on the top of the body 74*a* and have threaded bores 74*f* therein. The projections 74*e* are surrounded by the side walls 72*c* when the parts 72 and 74 are assembled so that the counterbores 72*d* align with the threaded bores 74*f* allowing the fasteners 76 to secure the parts together.

A template 80 overlies the top 72*a* of casing 70 and has an aperture 82 therein to expose the display surface 64*a* of the LCD panel 64. The template 80 carries indicia 82 (see FIG. 1*a*) concerning the units of the value displayed on the LCD panel 64, in the present example, average speed in miles per hour. The casing 70 and template 80 are slip-fitted into an open-ended, generally cylindrical canister 84 formed of clear plastic material. Adhesive also acts between the canister 84 and the casing 70 to inhibit their separation. The closed end 86 of the canister 84 has a curvature corresponding to the curvature of the outer skin 16 of the baseball 10.

The canister 84, template 80 and casing 70 form a rigid assembly that exhibits little flex giving the processing and display module 40 good strength to withstand impact forces applied to it when the baseball 10 is thrown and caught. Adhesive acts between the outer side surface 88 of the canister 84 and the interior of the baseball 10 surrounding bore 30 to fix the processing and display unit 40 in position so that the closed end 86 of the canister 84 remains flush with the outer skin 16 of the baseball. The space 90 between the processing and display unit 40 and the core 12 of the baseball 10 inhibits back pressure forces resulting from an impact, from forcing the processing and display unit 40 radially outwardly. Although not shown, adhesive urethane can be placed over the outer closed end 86 of the canister 84 to protect the canister and inhibit scratching. The adhesive urethane can of course be removed and replaced as required.

The inertial switch 42 is best illustrated in FIGS. 7*a* to 8*b* and as can be seen, includes a generally cylindrical, outer casing 100 formed of electrically conductive material such as for example stainless steel. A plastic end cap 102 is press-fitted into one end of the casing 100 to close the casing. An electrically conductive pin 104 is press-fitted into a central hole 106 in the end cap 102 and extends axially into the interior casing. The end cap 102 electrically isolates the pin 104 and the casing 100. An electrically conductive, helical coil spring 108 within the casing 100 is secured at one end thereof to the pin 104 by way of electrically conductive adhesive. The free end of the spring 108 floats within the casing 100 and typically remains spaced from the interior surfaces 100*a* of the casing to maintain the pin and casing in electrical isolation. The spring 108 and interior surfaces 100*a* of the casing are gold-plated to provide a low contact resistance between the spring 108 and the casing 100 when the spring and casing contact one another. A tab 110 is laser welded on the end of casing 100 and a tab 112 is laser welded on the pin 104. The electrical leads 46 extending from the processing and display module 40 are electrically connected to a respective one of the tabs 110 and 112.

The inertial switch 42 is centrally positioned and oriented within the bore 34 so that the longitudinal axis of the spring 108 is radially oriented to reduce the likelihood of rotational accelerations of the baseball causing the spring 108 to deflect and contact the interior surfaces of the casing 100 and thereby close the inertial switch 42. Adhesive acts between the outer surface of the casing 100 and the interior of the baseball 10 surrounding the bore to secure the position of the inertial switch 42. Further details of the inertial switch are set out in Applicant's co-pending application entitled "Inertial Switch" filed on even date now issued as U.S. Pat. No 5,786,553, the contents of which are incorporated herein by reference.

Figure 8A:
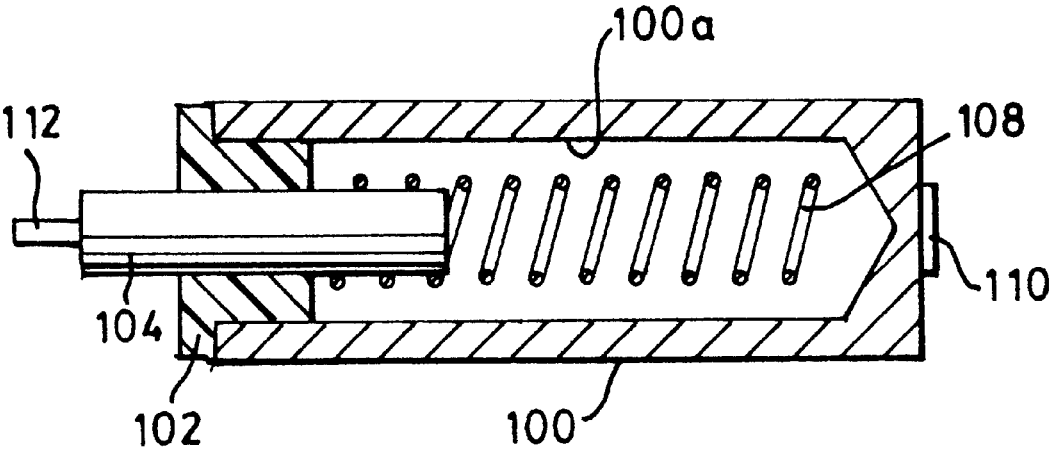
FIG. 8*a* is a cross-sectional view of the inertial switch of FIG. 7*a* in an open condition.
Figure 8B:
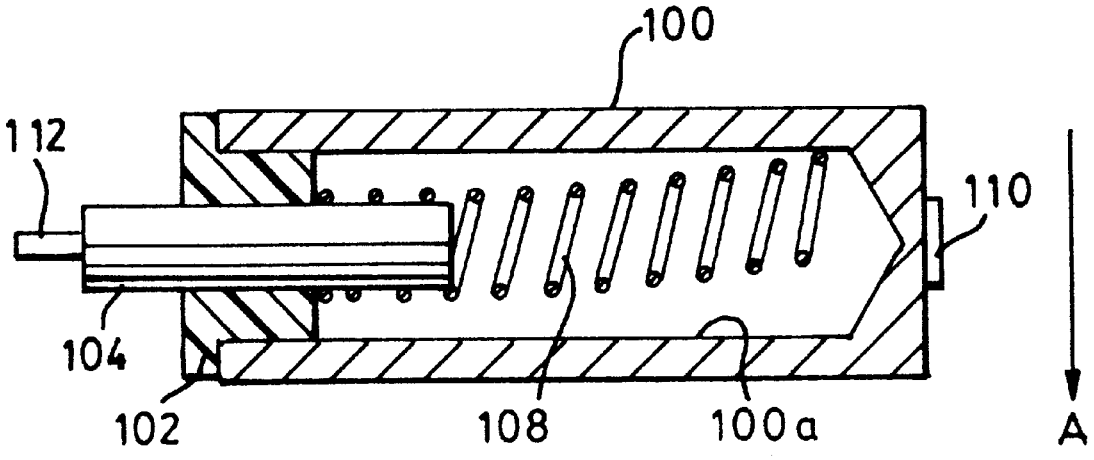
FIG. 8*b* is a cross-sectional view of the inertial switch of FIG. 7*a* in a closed condition.

When the baseball 10 is accelerated and the acceleration has a vector offset from the longitudinal axis of the spring 108 of inertial switch 42 as shown by arrow "A" in FIG. 8*b*, the spring 108 deflects about the pin 104. If the acceleration is above a predetermined threshold, the spring 108 will deflect and contact the interior surfaces 100*a* of the casing thereby electrically connecting the pin 104 and the casing 100 to close the inertial switch. In the present embodiment, the inertial switch 42 is designed to close in response to accelerations greater than or equal to approximately 12.5 g.

Figure 10:
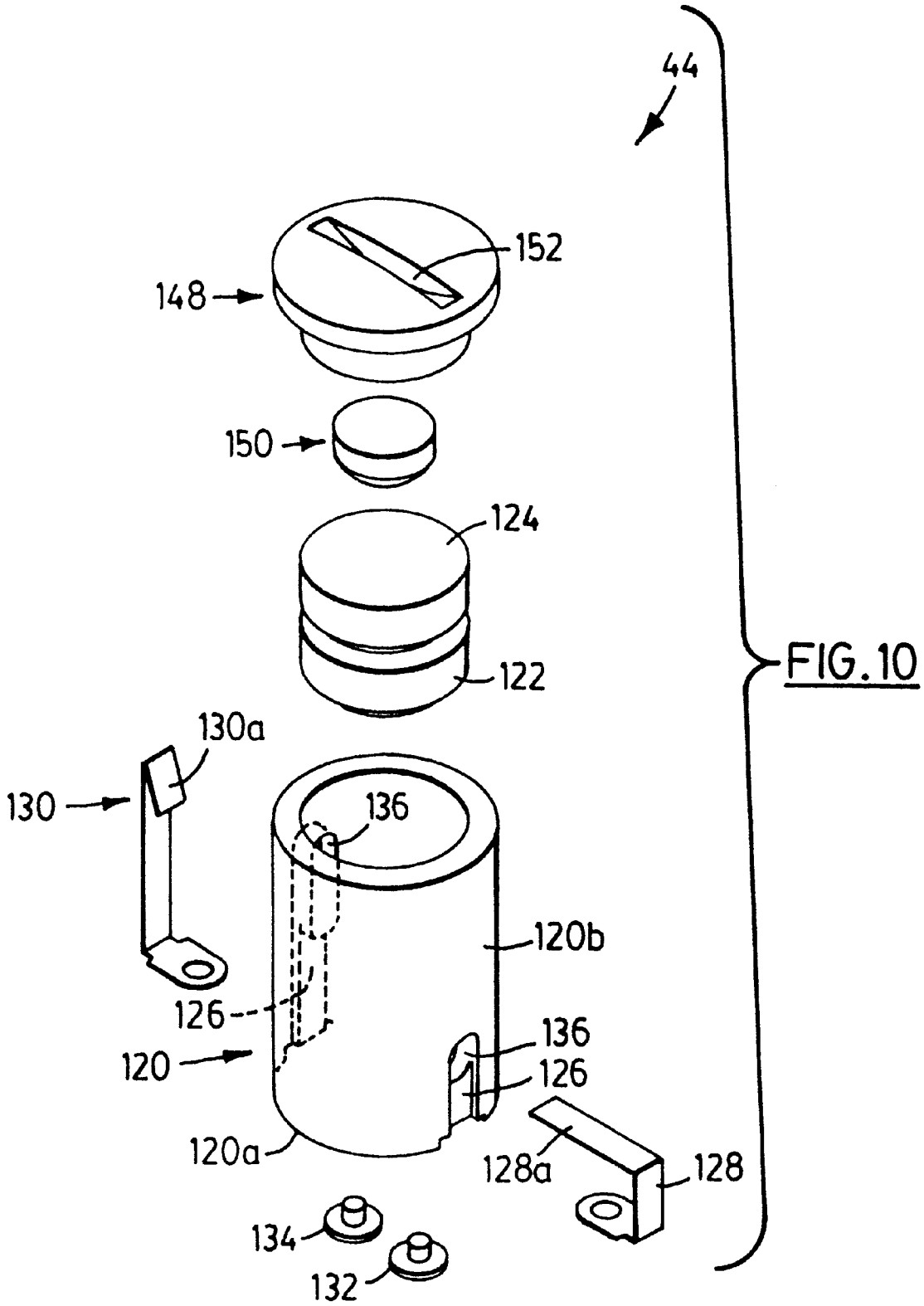
FIG. 10 is an exploded perspective view of a power supply module forming part of the speed-sensing baseball of FIG. 1.

The power supply module 44 is best illustrated in FIG. 10 and includes an open-ended generally cylindrical canister 120 receiving a pair of series connected batteries 122 and 124 respectively. The closed-end 120*a* and side wall 120*b* of the canister 120 have recesses 126 formed therein shaped to accommodate and electrically isolate a pair of metallic contacts 128 and 130 respectively. Conductive pins 132 and 134 pass through respective ones of the contacts to secure each of the contacts to the closed-end 120*a* of the canister 120. The electrical leads 48 are terminated at the conductive pins 132 and 134 by laser welds. The other ends of the contacts pass through openings 136 in the canister. In particular, one end 128*a* of contact 128 extends into the canister 120 generally parallel to the closed-end 120*a* and contacts the negative terminal the innermost battery 122. One end 130*a* of contact 130 is downwardly inclined within the canister 120 and contacts the positive terminal of the uppermost battery 124. An end cap 148 engages threads on the interior surface of the canister 120 adjacent its open-end to close the canister. A rubber stop 150 is provided on the interior surface of end cap 148 to contact the uppermost battery 124 and bias the batteries towards contact 128 to maintain the batteries 122 and 124 in contact with the contacts and to inhibit movement of the batteries within the canister 120. A slot 152 is formed in the outer surface of the end cap 148 and is sized to accommodate a tool such as the edge of a coin in the form of a dime or penny or alternatively a screwdriver or the like, to facilitate removal of the end cap 148 from the canister 120 should the batteries 122 and 124 need to be replaced. Adhesive acts between the outer surface of the canister 120 and the interior of the baseball 10 surrounding the bore 32 to secure the position of the power supply module 44.

Figure 11:
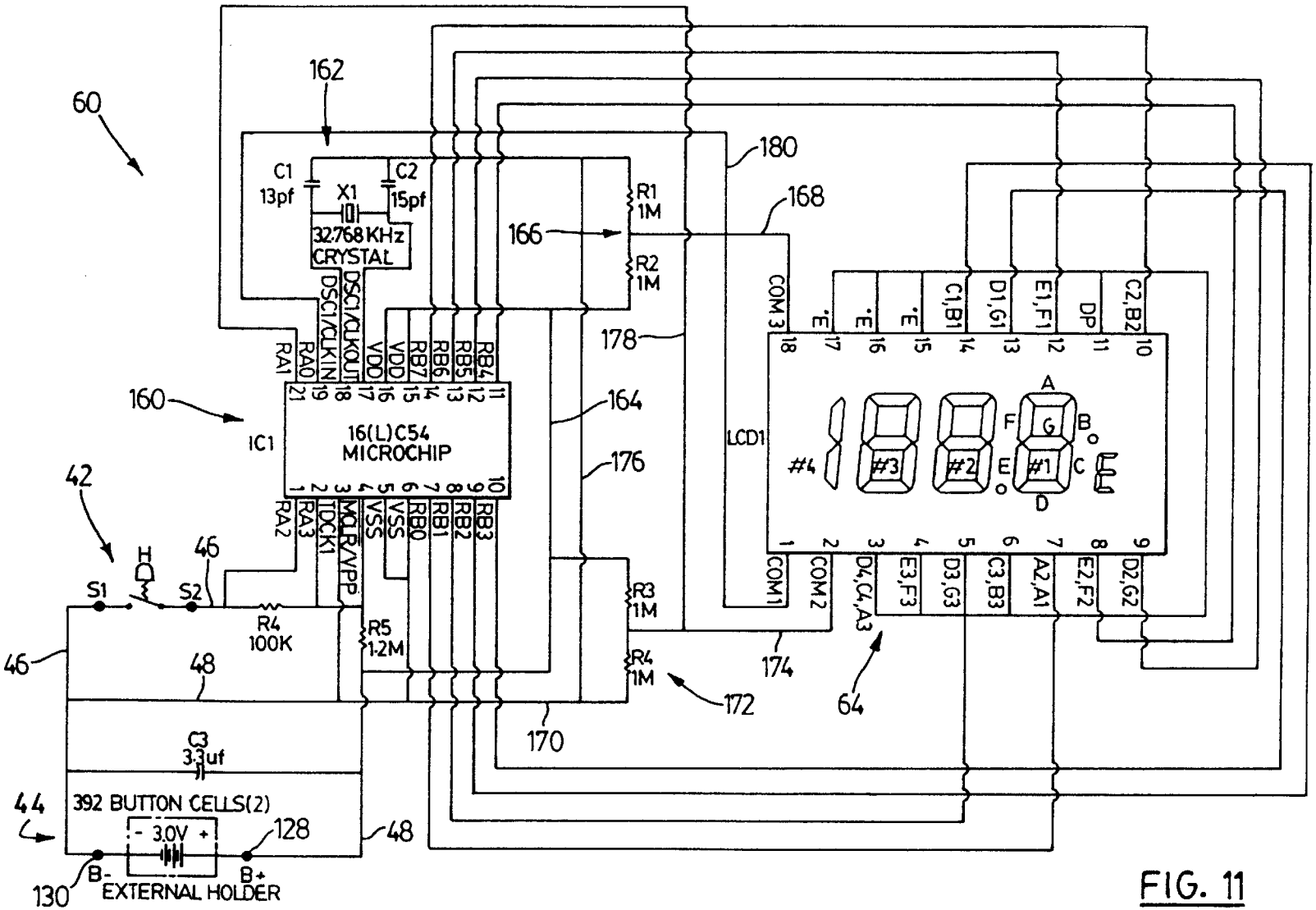
FIG. 11 is an electrical schematic of the speed sensing baseball of FIG. 1.

Referring now to FIG. 11, the processing unit 60 and LCD panel 64 are better illustrated. As can be seen, the processing unit 60 includes a microprocessor 160 with on-board memory such as that manufactured by Microchip under part number 16(L)C54. The microprocessor 160 drives the LCD panel 64 so that the calculated average speed of the baseball 10 can be displayed and is timed by a resonator 162 including a crystal X1 and a pair of capacitors C1 and C2. The electrical lead 48 terminated at contact 128 of the power supply module 44 is connected to the master clear ($\overline{\text{MCLR}}$) and RA3 pins of the microprocessor 160 as well as to the RA2 pin of the microprocessor 160 by way of a resistor R6. One of the electrical leads 46 couples tab 110 of the inertial switch 42 to the same pins of the microprocessor 160. The $\overline{\text{MCLR}}$ pin is also connected to the VDD pins of the microprocessor 160 by conductor 164. The VDD pins are also connected to the resonator 162 by way of a pair of series resistors R1 and R2 forming a voltage divider 166. A conductor 168 extends from the voltage divider 166 to the COM3 pin of the LCD panel 64.

The electrical lead 48 terminated at contact 130 of the power supply module 44 is connected to the TOCK1 pin of the microprocessor 160. The other of the electrical leads 46 couples tab 112 of the inertial switch 42 to the TOCK1 pin of the microprocessor 160. A conductor 170 connects the TOCK1 pin to conductor 164 through a pair of series resistors R3 and R4 forming a voltage divider 172. A conductor 174 extends from the voltage divider 172 to the COM2 pin of the LCD panel 64. A conductor 176 connects the conductor 170 to the resonator 162 and a conductor 178 connects conductor 174 to the RA1 pin of the microprocessor 160. A conductor 180 connects the RA0 pin of the microprocessor 160 to the COM1 and COM3 pins of the LCD panel 64. As will be appreciated by those of skill in the art, the microprocessor 160 and LCD panel 64 are interconnected in a conventional manner and therefore, no further discussion of the electrical arrangement of the microprocessor and LCD panel will be provided herein.

Figure 12:
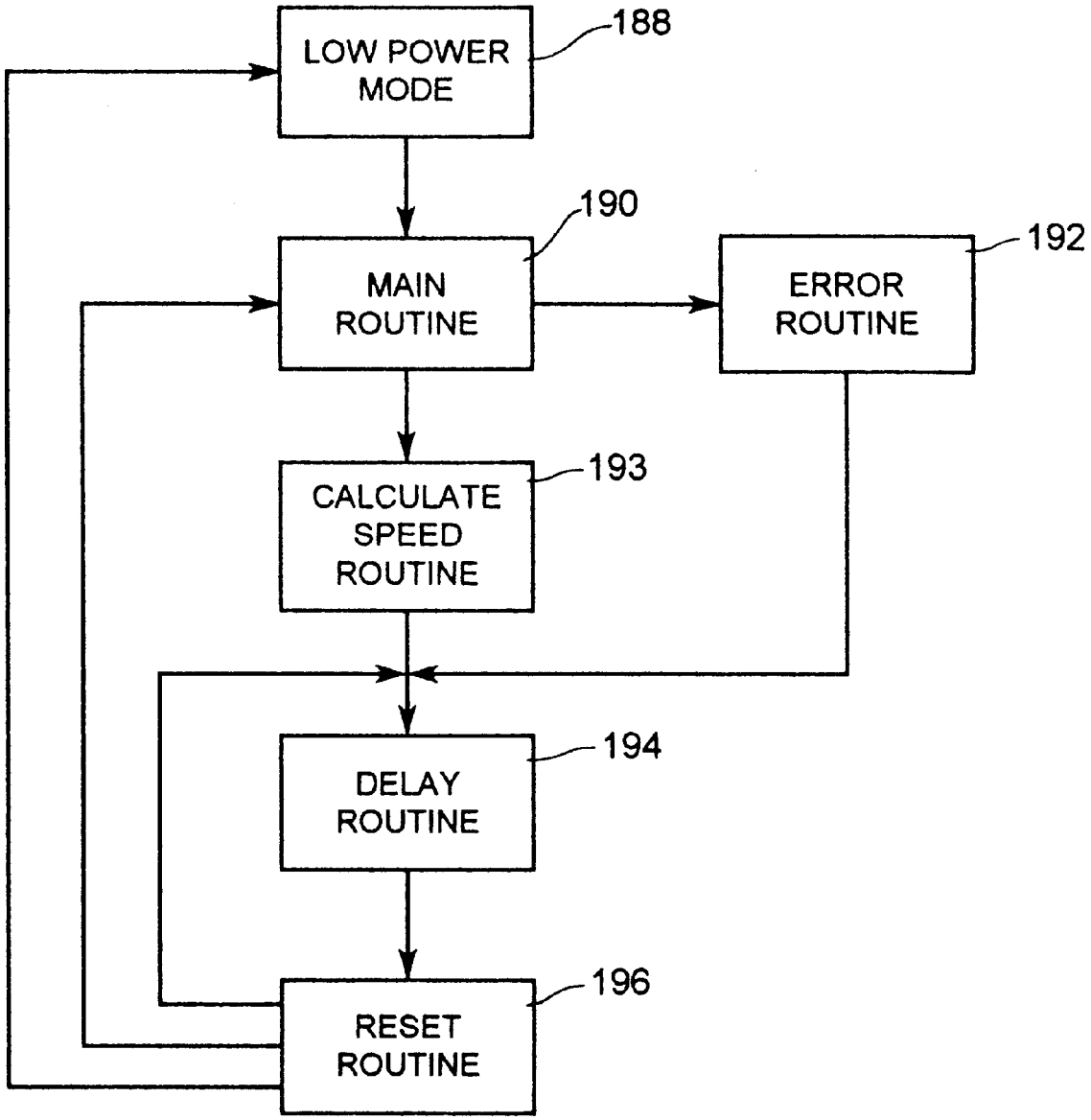
FIG. 12 is a flowchart showing the general operating steps performed by the speed-measuring and display unit of FIG. 4.
Figure 13A:
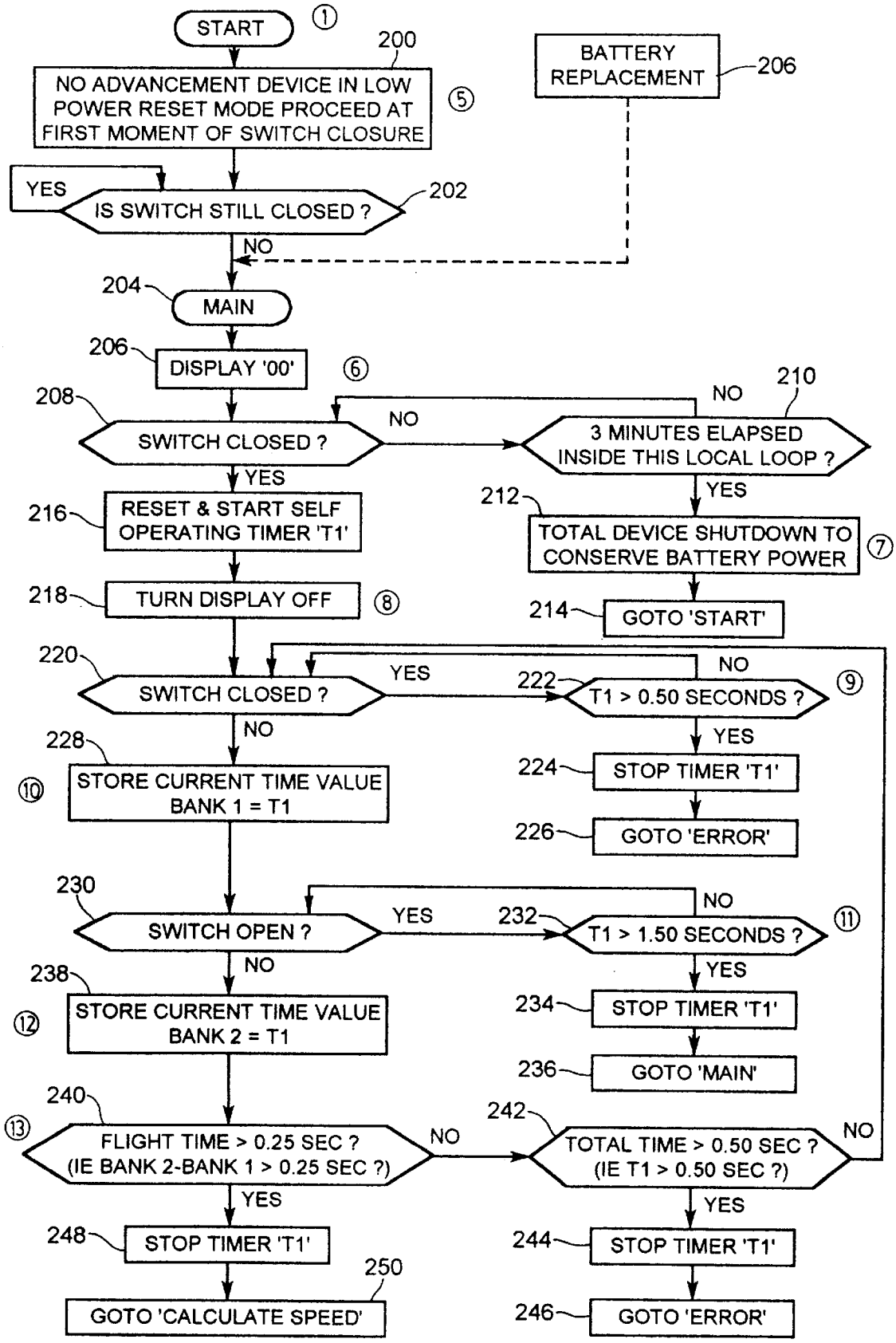
FIGS. 13*a* to 13*d* are flowcharts showing the steps performed by the speed-measuring and display unit of FIG. 4.
Figure 13B:
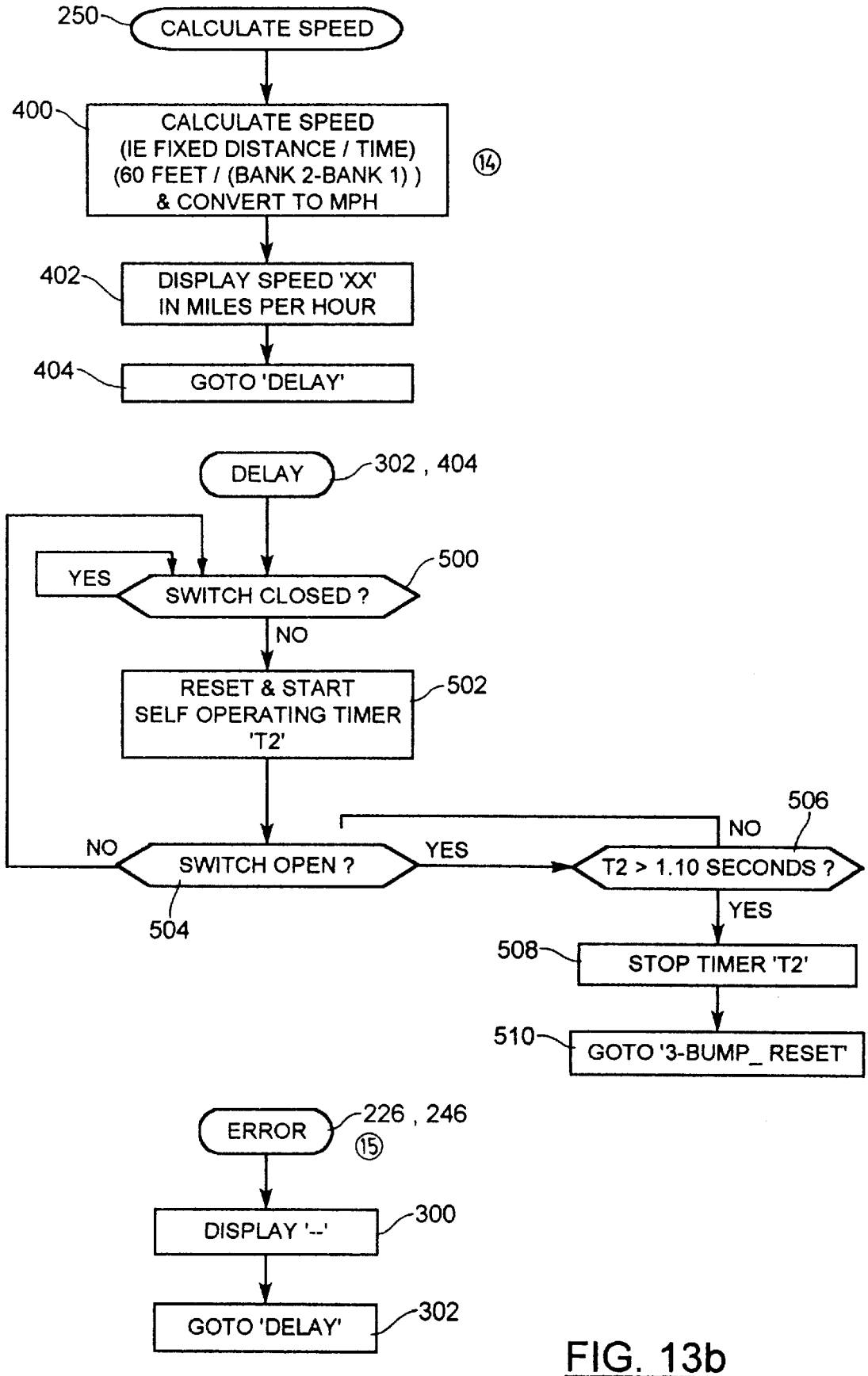
Figure 13C:
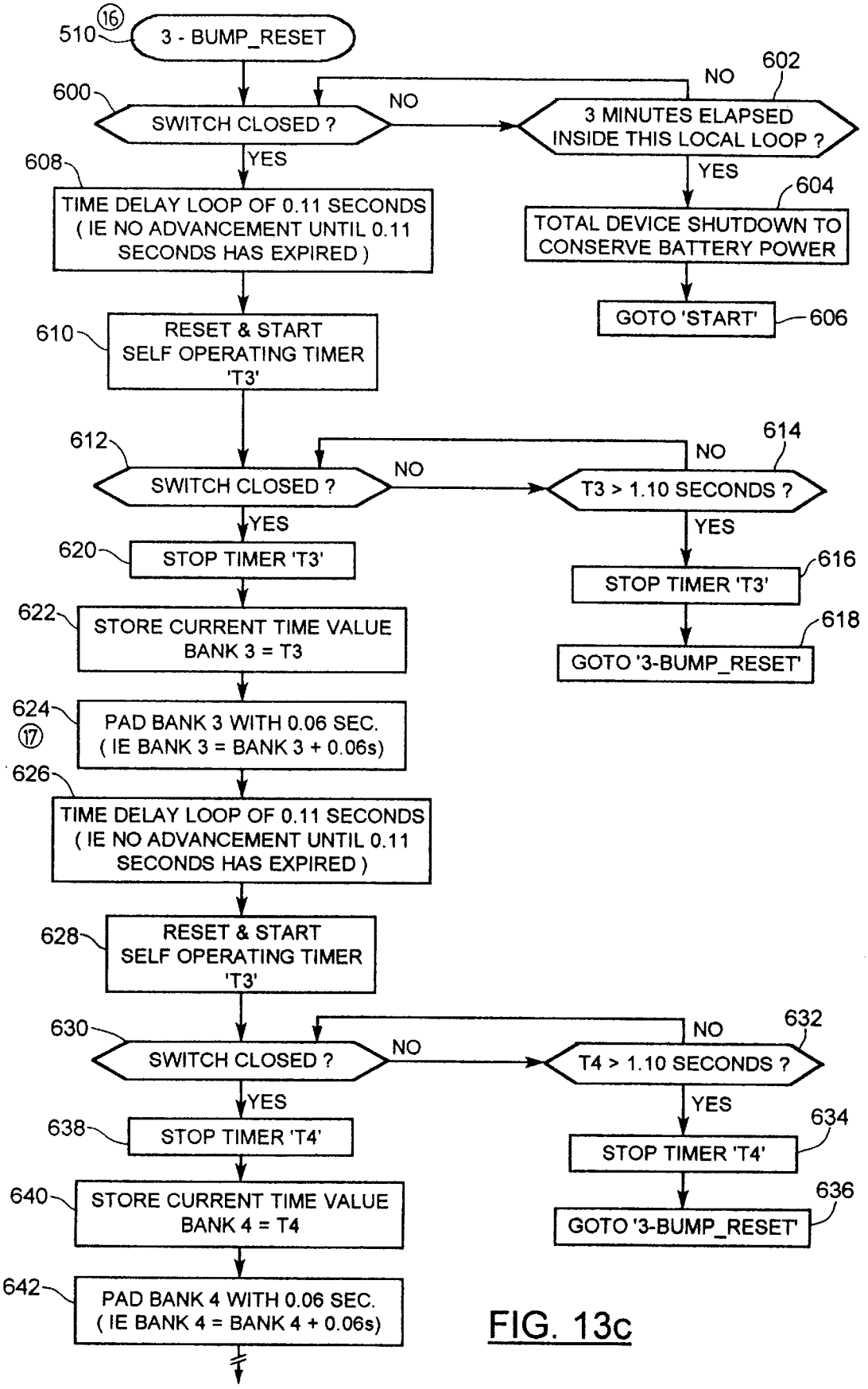
Figure 13D:
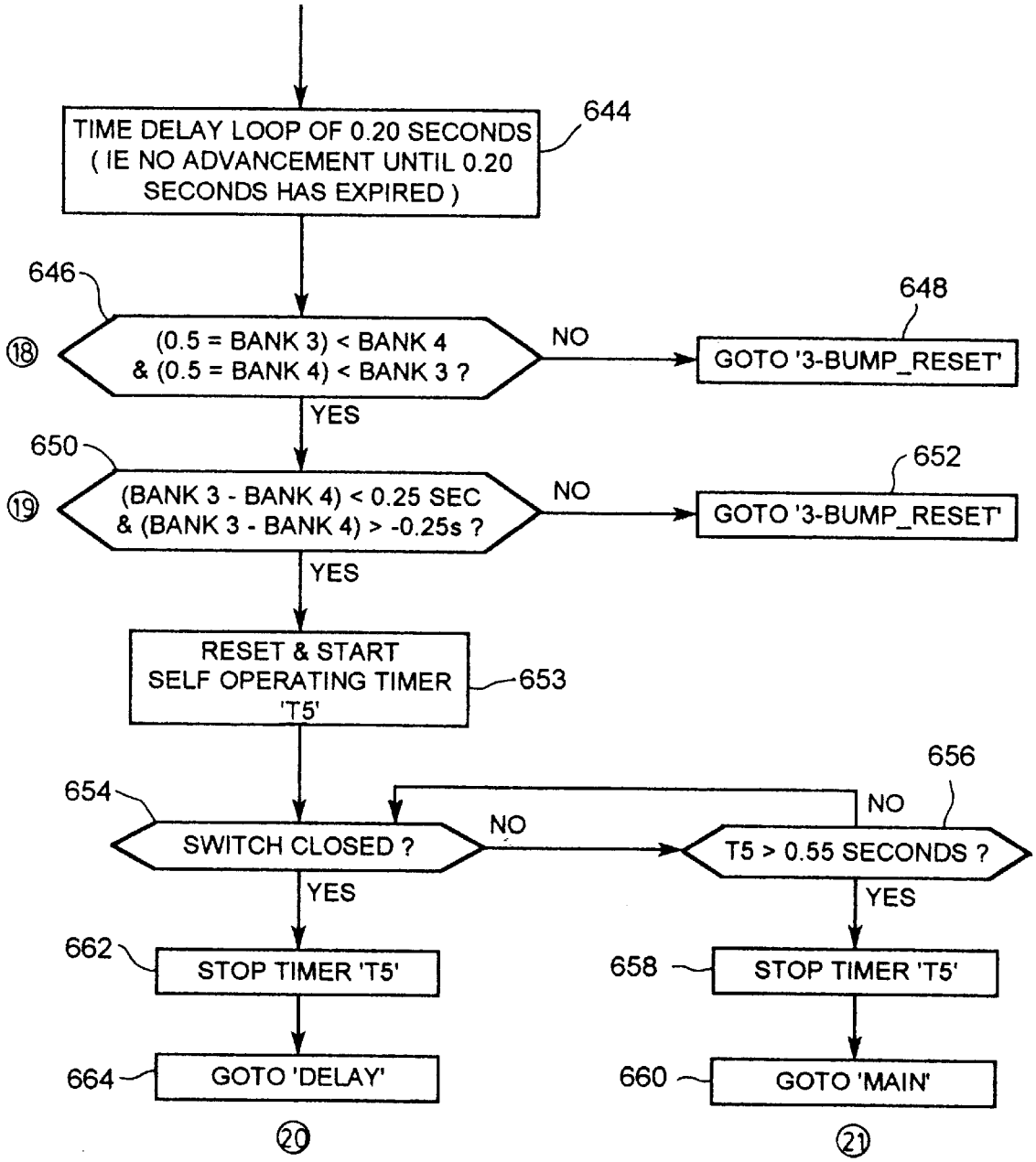

The microprocessor 160 executes software to allow the processing and display module 40 to detect when the baseball 10 is thrown and caught so that the average speed of the baseball can be calculated and displayed. The software executed by the microprocessor 160 also allows the processing and display module 40 to be reset but only after a predetermined sequence of events occurs and allows the processing and display module 40 to be conditioned to a low power "sleep" mode 188 (see FIG. 12) due to inactivity in order to conserve power. Details of the operation of the processing and display module 40 as the microprocessor 160 executes the software will now be described with particular reference to FIGS. 12 and 13*a* to 13*d*.

When a baseball is thrown, the baseball 10 travels through a curvilinear path as the thrower winds up, delivers and releases the baseball. The baseball also travels through a curvilinear path from the time the baseball is released to the time the baseball is caught. During the time the baseball is held by the thrower and prior to the baseball being released, the baseball undergoes a number of accelerations which will cause the inertial switch 42 to move between open and closed conditions. Once released the baseball will not undergo any significant accelerations until the baseball is caught.

Figure 9:
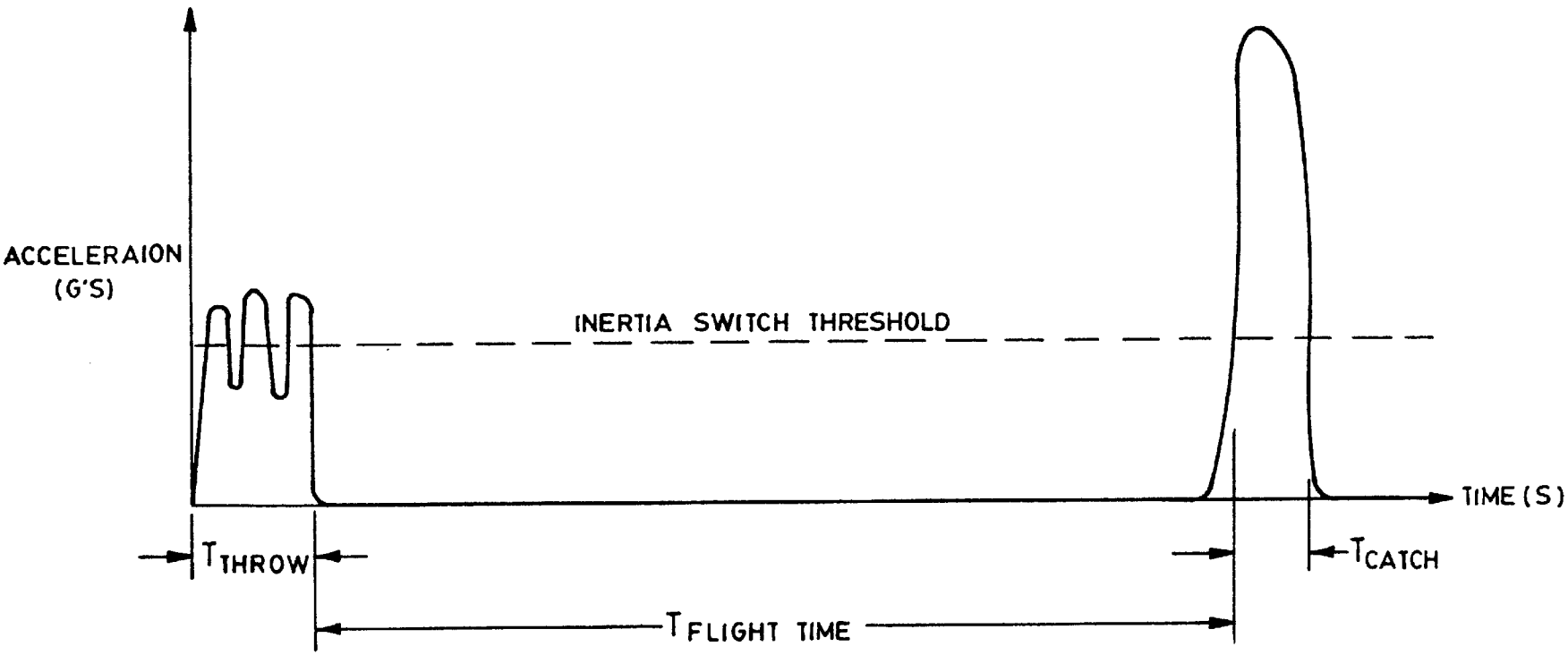
FIG. 9 is an acceleration vs. time graph of the response of the inertial switch of FIG. 7*a* during a throw and subsequent catch of the baseball of FIG. 1.

FIG. 9 shows an acceleration versus time graph illustrating the accelerations of a thrown baseball 10. As can be seen in this example, the baseball 10 undergoes three accelerations during time interval $T_{throw}$ while the thrower is winding up and delivering the baseball which cause the inertial switch 42 to close before the baseball is actually released. The baseball then undergoes no appreciable acceleration during its flight time interval $T_{flight}$ until the baseball 10 is caught at time interval $T_{catch}$. Because the baseball 10 undergoes a number of accelerations which cause the inertial switch 42 to close before the baseball is actually released, it is desired to examine the time interval between successive inertial switch closings before the flight time timer is started to maintain speed calculation accuracy.

In general, in order to calculate and display the average speed of the thrown baseball 10, the microprocessor 160 in processing and display module 40 executes a main routine 190 and monitors the inertial switch 42 to detect movement of the inertial switch between open and closed conditions. As mentioned previously, the inertial switch 42 closes when the baseball 10 undergoes an acceleration greater than approximately 12.5 g. When the inertial switch closes, the RA2 pin of microprocessor 160 is deasserted allowing the microprocessor to detect closings of the inertial switch. RA3 pin of microprocessor 160 remains high to inhibit the $\overline{\text{MCLR}}$ pin from going low which would result in a reset of the microprocessor 160. The openings and closings of the inertial switch are monitored by the microprocessor 160 until the microprocessor determines that the baseball has actually been released. The microprocessor 160 then waits until the inertial switch 42 closes again assuming that the baseball has been caught and the flight time of the baseball is measured. If the flight time is less than a predetermined value, the microprocessor 160 enters a calculate speed routine 193 and the average speed of the baseball is calculated based on the assumption that the baseball has been thrown a fixed distance. In this particular embodiment, the fixed distance is set to 60 ft, the typical distance between home plate and the pitcher's mound.

If the flight time is greater than the predetermined value signifying that the baseball has been thrown less than 27 miles per hour, the speed is not calculated or displayed on the LCD panel 64. If the flight time is less than another predetermined value signifying an improper operating condition, the microprocessor 160 executes an error routine 192. Following the above the microprocessor 160 then enters a delay routine 194 to allow the speed-sensing unit 20 to settle. In this particular embodiment, the microprocessor 160 remains in the delay routine until at least 1.1 seconds have elapsed without a closing of the inertial switch occurring.

Once the delay routine 194 has been completed, the microprocessor executes a reset routine 196 to allow the LCD panel 64 to be cleared. The speed will remain on the LCD panel 64 until the LCD panel is cleared by the microprocessor. In order to clear the LCD panel 64, the baseball 10 must be tapped three consecutive times in a manner sufficient to close the inertial switch 42 and so that a certain amount of time elapses between successive closings of the inertial switch. The time requirement between successive closings reduces the likelihood that random closings of the inertial switch resulting from a dropped and/or rolling baseball will not result in the LCD panel 64 being cleared. In this particular embodiment, the three consecutive closings of the inertial switch 42 resulting from the taps must be between a minimum and maximum rate for compliance as a recognizable pattern. To reduce rejections at tapping rates near the maximum rate, the measured durations between successive taps are given an arithmetic offset. Also, in order to comply as a recognizable pattern, the time period between any two consecutive taps must be within 50% of one another or the entire reset routine must be performed again. Furthermore, the maximum difference between the measured durations must not exceed 0.25 seconds which becomes important at low tap rates. Lastly, once the three tap pattern has been recognized, an additional 0.55 seconds must elapse without an inertial switch closing occurring or else the rest routine must be performed again.

The specific steps performed by the microprocessor 160 during execution of the routines 188 to 196 will now be described with particular reference to FIGS. 13*a* to 13*d*. Initially it will be assumed that the speed-sensing baseball 10 has been inactive for more than three minutes and the processing and display module 40 is conditioned to the low power "sleep" mode to conserve power. In the low power "sleep" mode, the microprocessor 160 monitors the inertial switch 42 via the $\overline{\text{MCLR}}$ pin to detect when the inertial switch 42 has moved from an open condition to a closed condition (block 200) which results in the $\overline{\text{MCLR}}$ pin going low. Once the inertial switch 42 has been closed, the microprocessor 160 continues to monitor the inertial switch 42 to detect when the inertial switch moves back to an open condition (block 202). Once the inertial switch 42 moves to the open condition, the processing and display module 40 moves out of the low power "sleep" mode and the microprocessor 160 begins execution of the main routine 190 (block 204). When the processing and display module 40 is conditioned to the low power "sleep" mode, if the batteries 122 and 124 in the power supply module 44 are replaced or are removed and reinserted, the processing and display module 40 also moves out of the low power "sleep" mode and the microprocessor 160 begins execution of the main routine 190 (block 204).

Upon entering the main routine, the microprocessor 160 resets the LCD panel 64 to display "00" (block 206). The microprocessor 160 then initiates a timer and monitors the inertial switch 42 to detect when the inertial switch 42 moves from an open condition to a closed condition (blocks 208 and 210). If the inertial switch 42 does not move to the closed condition before the timer reaches a three minute count, the microprocessor 160 conditions the processing and display module 40 back to the low power "sleep" mode (block 212) and microprocessor 160 reverts back to block 200 (block 214).

However, if the inertial switch 42 moves to the closed condition before the timer reaches a three minute count, the timer is reset and a self-operating timer "T1" is reset and then initiated (block 216). Following this, the microprocessor 160 turns the LCD panel 64 off (block 218) and then monitors the status of the inertial switch 42 (blocks 220 and 222) to detect when the inertial switch moves back to an open condition. If the inertial switch 42 does not move to an open condition before timer T1 reaches a count equal to 0.5 seconds, the microprocessor 160 assumes that a technical problem with the baseball or abnormal usage of the baseball has occurred. This is due to the fact that a throw motion or windup will typically always take less than 0.5 seconds to complete. The microprocessor in turn stops the timer T1 (block 224) and then enters the error routine 192 (block 226).

If the inertial switch 42 moves back to the open condition before the timer T1 reaches the 0.5 second count, the current time value of the timer T1 is stored in memory location Bank 1 (block 228). The inertial switch 42 is once again monitored by the microprocessor 160 to detect when the inertial switch moves to a closed condition (blocks 230 and 232). If the inertial switch does not move back to the closed condition before the timer T1 reaches a count equal to 1.5 seconds, the microprocessor 160 stops the timer T1 (block 234) and then reverts back to block 204 (block 236). At this point, the value of the timer T1 represents the total amount of time that has elapsed since the first closing of the inertial switch 42 following the start of the main routine as a result of a windup and including the flight time of the baseball. This duration will typically always be less than 1.5 seconds unless the baseball has been thrown less than 27 mph.

If the inertial switch 42 moves back to the closed condition before the timer T1 reaches a count equal to 1.5 seconds, the current time value of the timer T1 is stored in memory location Bank2 which represents the sum of the throw time and the flight time (block 238). The microprocessor 160 then calculates the flight time of the baseball by subtracting the time value in memory location Bank 1 from the time value in memory location Bank2 to determine if the flight time is greater than 0.25 seconds (block 240). If the flight time is less than 0.25 seconds, the microprocessor 160 examines the timer T1 to determine if the current time value is greater than 0.5 seconds (block 242). If the current time value of the timer T1 is less than 0.5 seconds, the microprocessor 160 reverts back to block 220 since it is assumed that the baseball is undergoing accelerations as a result of a throw motion or windup. However, if the current value of the timer T1 is greater than 0.5 seconds, the microprocessor 160 stops the timer T1 (block 244) and enters the error program routine 192 (block 246).

At block 240, if the flight time is detected to be greater than 0.25 seconds, the microprocessor 160 stops the timer T1 (block 248) and then enters a calculate speed routine 193 (block 250).

When the microprocessor enters the error routine 192 at block 226 or 246, the microprocessor 160 conditions the LCD panel 64 to display "--" (block 300) and then enters the delay routine 194 (block 302).

When the microprocessor 160 enters the calculate speed routine 193 at block 250, the microprocessor 160 calculates the average speed at which the baseball was thrown over the fixed distance by dividing 60 ft by the flight time calculated at block 240 and converting the result into miles per hour (block 400). Once the speed has been calculated and converted into miles per hour, the microprocessor 160 conditions the LCD panel 64 to display the calculated speed (block 402). Following this, the microprocessor 160 enters the delay routine 194 (block 404).

When the microprocessor enters the delay routine 194 via block 302 or 404, the microprocessor 160 monitors the inertial switch 42 to determine if the inertial switch is closed (block 500). When the inertial switch 42 moves to an open condition, the microprocessor 160 resets and starts another self-operating timer T2 (block 502). The microprocessor 160 again monitors the inertial switch 42 to detect if the inertial switch moves to a closed condition before the timer T2 reaches a count equal to 1.1 seconds (blocks 504 and 506). If the inertial switch 42 moves to a closed condition before the timer T2 reaches a count equal to 1.1 seconds, the microprocessor 160 reverts back to block 500. Otherwise, when the timer T2 reaches the count equal to 1.1 seconds, the microprocessor 160 stops the timer T2 (block 508) and then enters the reset routine 196 (block 510).

When the microprocessor 160 enters the reset routine 196 at block 510, the microprocessor 160 initiates a timer and monitors the inertial switch 42 to detect when the inertial switch 42 moves from an open condition to a closed condition (blocks 600 and 602). If the inertial switch 42 does not move to the closed condition before the timer reaches a three minute count, the microprocessor 160 conditions the processing and display module 40 back to the low power "sleep" mode (block 604) and microprocessor 160 reverts back to block 200 (block 606).

However, if the inertial switch 42 moves to the closed condition before the timer reaches a three minute count, the microprocessor 160 enters a 0.11 second delay loop (block 608). Following the delay loop, the microprocessor resets and initiates a third self-operating timer T3 (block 610) and then monitors the inertial switch 42 to detect if the inertial switch 42 moves to a closed condition before the timer T3 reaches a count equal to 1.1 seconds (blocks 612 and 614). If the inertial switch 42 does not close before the timer T3 reaches the 1.1 second count, the microprocessor stops the timer T3 (block 616) and reverts back to block 510 (block 618).

If the inertial switch 42 closes before the timer T3 reaches the 1.1 second count, the microprocessor stops the timer T3 (block 620) and then stores the current time value of the timer T3 in memory location Bank3 (block 622). The microprocessor 160 then pads the time value in memory location Bank3 by adding 0.06 seconds to it (block 624) and then enters another 0.11 second delay loop (block 626).

Following the delay loop, the microprocessor 160 resets and initiates a fourth self-operating timer T4 (block 628) and then monitors the inertial switch 42 to detect if the inertial switch 42 moves to a closed condition before the timer T4 reaches a count equal to 1.1 seconds (blocks 630 and 632). If the inertial switch 42 does not close before the timer T4 reaches the 1.1 second count, the microprocessor 160 stops the timer T4 (block 634) and reverts back to block 510 (block 636).

If the inertial switch 42 closes before the timer T4 reaches the 1.1 second count, the microprocessor stops the timer T4 (block 638) and then stores the current time value of the timer T4 in memory location Bank4 (block 640). The microprocessor 160 then pads the time value in memory location Bank4 by adding 0.06 seconds to it (block 642) and then enters a 0.2 second delay loop (block 644).

Following the delay loop, the microprocessor 160 checks to see if the time value in memory location Bank4 is greater than half of the time value in memory location Bank3 and if the time value in memory location Bank3 is greater than half of the time value in memory location Bank4 (block 646). If these logic conditions are not met, the microprocessor 160 reverts back to block 510 (block 648). If these logic conditions are met, the difference between the time values in memory locations Bank3 and Bank4 is calculated and is checked to see if the difference is less than 0.25 seconds and greater than −0.25 seconds (block 650). If these logic conditions are not met, the microprocessor 160 reverts back to block 510 (block 652).

If these logic conditions are met, the microprocessor 160 resets and initiates a fifth self-operating timer T5 (block 654) and then monitors the inertial switch 42 to determine of the inertial switch moves to a closed condition before the timer T5 reaches a count equal to 0.55 seconds (blocks 656 and 658). If the inertial switch does not close before the timer T5 reaches a count equal to 0.55 seconds, the microprocessor 160 stops the timer T5 (block 660) and then reverts to block 204 of the main routine 190 (block 662). However, if the inertial switch 42 closes before the timer T5 reaches a count equal to 0.55 seconds, the microprocessor 160 stops the timer T5 (block 664) and then reverts back to the delay routine 194 (block 664).

As will be appreciated by those of skill in the art, the present invention allows the average speed of the baseball to be sensed and displayed without requiring the thrower to hold onto the baseball in a specific manner prior to throwing the baseball. The displayed speed remains displayed on the LCD panel 64 until cleared by the microprocessor 160. Since a sequence of events, which typically does not occur naturally when a baseball is being thrown and caught and/or dropped, must be completed before the LCD panel 64 is cleared the thrower is almost always able to determine visually the speed at which the baseball is thrown.

Although the microprocessor 160 clears the LCD panel only after the sequence of three taps has occurred within the predetermined period of time, the microprocessor can be programmed to simply wait until a predetermined amount of time has elapsed after the speed of the thrown baseball is displayed before clearing the LCD panel.

If desired, the microprocessor 160 can also be programmed to calculate and display a running average of the speed the baseball is thrown and/or a count of the number of times the baseball is thrown. In this instance, the microprocessor 160 can be programmed to be responsive to sequences of taps of the baseball different from that which clears the LCD panel to display and reset the running average and/or the throw count. In addition, the microprocessor 160 can also be programmed to allow the fixed distance to be selected from a number of values stored in its on-board memory. Similarly the microprocessor would be responsive to a sequence of taps of the baseball to change the selected fixed distance. The fixed distance would be displayed on the LCD panel to allow the thrower to determine visually the fixed distance setting.

With respect to the inertial switch, although the electrical leads 46 have been described as being connected to the tabs 110 and 112 on inertial switch 42 via laser welds, it should be apparent that other standard terminations for the electrical leads 46 such as for example through-the-hole technology or surface mount pads can be used. In addition, the casing 100, although described as being cylindrical, may be of another geometrical configuration. If through-the-hole technology or surface mount pads are used to terminate the electrical leads 46, a casing with a generally rectangular profile to present flat surfaces is preferred. Furthermore, although the spring 108 has been described as being attached to the pin by electrically conductive adhesive, other techniques such as soldering or laser welding can be used provided care is taken not to affect adversely the load versus deflection characteristics of the spring 108.

With respect to the power supply module 44, although the canister 120 is shown to accommodate a pair of series connected batteries 122 and 124, those of skill in the art will appreciate that the number of batteries is arbitrary and may vary depending of the power requirements of the microprocessor 160 and LCD panel 64. Also, the canister 120 and end cap 148 may be permanently sealed to inhibit replacement of the batteries. In this case, the slot 152 in end cap 148 is unnecessary and the speed-sensing capabilities of the baseball will function until the power level of the batteries falls to a point insufficient to power the processing and display module 40.

Although the preferred embodiments have been described as speed-sensing baseballs, those of skill in the art will appreciate that other projectiles such as hockey pucks, lacrosse balls or the like can incorporate the speed-measuring unit to allow the speed at which the projectile is launched and subsequently stopped to be determined. In addition, although preferred embodiments have been described, it should be apparent that other variations and modifications are well within the scope of the present invention as defined by the appended claims.

I claim:

1. A speed-sensing projectile comprising:

a solid, generally spherical body having at least one bore formed therein;

an inertial switch within said body and accommodated by said at least one bore, said inertial switch being actuable between open and closed conditions in response to accelerations of said body;

a processor within said body and accommodated by said at least one bore, said processor being responsive to actuations of said inertial switch to detect launching of said projectile and the subsequent stopping thereof and calculating the average speed of said projectile over the travel thereof; and a visible display on said body and being in communication with said processor to display said calculated average speed.

2. A speed-sensing projectile as defined in claim 1 wherein said processor calculates the average speed of said projectile by determining the elapsed time between launching of said projectile and the subsequent stopping thereof and assuming said projectile has traveled a fixed distance.

3. A speed-sensing projectile as defined in claim 2 wherein said processor does not calculate said average speed if said elapsed time is greater than a predetermined threshold value.

4. A speed-sensing projectile as defined in claim 2 wherein said processor is conditioned to a sleep mode if a preset amount of time elapses without said inertial switch moving to a closed condition.

5. A speed-sensing projectile as defined in claim 2 wherein said body includes a core, a wound layer surrounding said core and an outer skin surrounding said wound layer and wherein a single diametric bore extends through said body.

6. A speed-sensing projectile as defined in claim 5 wherein said diametric bore has larger diameter portions at opposite ends thereof extending through said skin and wound layer and a smaller diameter portion extending through said core, said inertial switch being generally centrally positioned within said smaller diameter portion.

7. A speed-sensing projectile as defined in claim 6 wherein said inertial switch includes an outer casing having a conductive inner surface defining one terminal thereof and an electrically conductive spring member in said casing defining another terminal thereof, said spring member being electrically isolated from said conductive surface but being movable in response to accelerations of said projectile to contact said conductive surface and close said inertial switch.

8. A speed-sensing projectile as defined in claim 7 wherein said spring member is in the form of a helical coil spring secured at one end to a conductive pin passing through an insulated cap on one end of said casing.

9. A speed-sensing projectile as defined in claim 8 wherein said spring is secured to said conductive pin by electrically conductive adhesive.

10. A speed-sensing projectile as defined in claim 6 wherein said display is resettable.

11. A speed-sensing projectile as defined in claim 10 wherein said processor resets said display in response to the detection of a predetermined sequence of events.

12. A speed-sensing projectile as defined in claim 11 wherein said predetermined sequence of events is at least three impacts of said projectile occurring within a specified period of time which cause said inertial switch to move to closed conditions.

13. A speed-sensing projectile as defined in claim 12 wherein said predetermined sequence of events requires a specified amount of time to elapse between each of said at least three impacts.

14. A speed-sensing projectile as defined in claim 13 wherein said processor waits for a predetermined amount of time to elapse after said predetermined sequence of events occurs without said inertial switch closing before resetting said display.

15. A speed-sensing projectile as defined in claim 6 further comprising a power supply accommodated by one of said larger diameter portions and being electrically coupled to said inertial switch, to said processor and to said display, said processor and display being accommodated by another of said larger diameter portions.

16. A speed-sensing projectile as defined in claim 15 wherein said power supply is weighted to counterbalance said processor and display.

17. A speed-sensing projectile as defined in claim 16 wherein said power supply includes at least one replaceable battery accommodated in a canister secured within said one larger diameter portion, said canister having a removable cap adjacent an outer surface of said body.

18. A speed-sensing projectile as defined in claim 17 wherein said cap has a groove therein sized to receive a tool to facilitate rotation of said cap.

19. A speed-sensing baseball comprising:

a generally spherical, solid body;

an inertial switch actuable between open and closed conditions in response to accelerations of said body;

a processor responsive to said inertial switch to calculate the average speed at which said baseball is thrown over a fixed distance, said inertial switch and said processor being positioned within a bore formed in said body; and a visible display on said body and being in communication with said processor to display said calculated average speed.

20. A speed-sensing baseball as defined in claim 19 wherein said processor is responsive to user input to change said fixed distance.

21. A speed-sensing baseball as defined in claim 20 wherein said user input is in the form of a predetermined sequence of taps of said baseball which cause said inertial switch to move to closed conditions.

22. A speed-sensing baseball as defined in claim 19 wherein said processor maintains a pitch count.

23. A speed-sensing baseball as defined in claim 19 wherein said inertial switch is centrally positioned within said body.

24. A speed-sensing baseball as defined in claim 23 wherein said processor and display are housed within a casing accommodated in said bore.

25. A speed-sensing baseball as defined in claim 24 further comprising a power supply including a canister in said bore and accommodating at least one replaceable battery, said casing and said canister being positioned in said bore at diametric locations to counterbalance said baseball.

26. A speed-sensing baseball as defined in claim 19 wherein said processor resets said display in response to the detection of a predetermined sequence of taps of said baseball which cause said inertial switch to move to closed conditions.

27. A speed-sensing baseball as defined in claim 26 wherein said predetermined sequence of taps includes three taps of said baseball with a specified amount of time elapsing between successive taps.

28. A speed-sensing baseball as defined in claim 27 wherein said processor waits for a predetermined amount of time to elapse after said three taps have occurred without said inertial switch closing before resetting said display.

29. A speed-sensing projectile comprising:

a body;

a processor within said body, said processor monitoring the elapsed time said body takes to travel a fixed distance and calculating the average speed at which said projectile travels over said fixed distance; and a display responsive to said processor and presenting said average speed, wherein said processor resets said display in response to the detection of a predetermined sequence of events in the form of at least three impacts of said projectile occurring within a specified period of time, with a specified amount of time elapsing between each of said at least three impacts.

30. A speed-sensing projectile as defined in claim 29 wherein said processor waits for a predetermined amount of time to elapse after said predetermined sequence of events occurs without said inertial switch closing before resetting said display.

31. A speed-sensing projectile as defined in claim 29 wherein said processor is responsive to user input to change said fixed distance.

32. A speed-sensing projectile as defined in claim 31 wherein said user input is in the form of a predetermined sequence of taps of said baseball which cause said inertial switch to move to closed conditions.

33. A speed-sensing projectile as defined in claim 32 wherein said fixed distance is selectable from a plurality of preset fixed distances.

34. The method of claim 31 further comprising the step of resetting said count in response to a predetermined sequence of taps which cause said inertial switch to move to closed conditions.

35. A speed-sensing projectile as defined in claim 29 wherein said processor maintains a pitch count.

36. A speed-sensing projectile as defined in claim 29 wherein said processor does not calculate said average speed if said elapsed time is greater than a predetermined threshold value.

37. A speed-sensing projectile as defined in claim 29 wherein said processor is conditioned to a sleep mode if a preset amount of time elapses without said inertial switch moving to a closed condition.

38. A method of determining and displaying the speed at which a baseball is thrown over a fixed distance, said baseball having a single inertial switch and a processor therein, said processor being responsive to said inertial switch, said method comprising the steps of:

initiating a timer in response to throwing of said baseball as detected by said inertial switch;

stopping said timer when said baseball is caught as detected by said inertial switch;

dividing said fixed distance by the elapsed time of said timer; and displaying the result.

39. The method of claim 38 further comprising the step of resetting the display in response to a predetermined sequence of taps of said baseball which cause said inertial switch to move to closed conditions.

40. The method of claim 39 wherein said predetermined sequence of taps includes at least three taps of said baseball with a specified amount of time elapsing between each successive tap.

41. The method of claim 40 further comprising the step of waiting for a predetermined amount of time to elapse after said three taps of said baseball have occurred before resetting the display.

42. The method of claim 38 further comprising the step of maintaining a count of the number of times said baseball is thrown.

43. The method of claim 38 wherein said fixed distance is user selectable, said method further comprising the step of selecting said fixed distance by tapping said baseball a predetermined number of times causing said inertial switch to move to closed conditions.

* * * * *